US009351343B2

(12) United States Patent
Nagasaka et al.

(10) Patent No.: US 9,351,343 B2
(45) Date of Patent: May 24, 2016

(54) HEATER CONTROL DEVICE, AND CONTROL METHOD AND CONTROL PROGRAM FOR HEATER CONTROL DEVICE

(75) Inventors: Keiji Nagasaka, Tokyo (JP); Hidetaka Sato, Tokyo (JP); Koji Nakano, Tokyo (JP); Shiro Matsubara, Tokyo (JP); Satoshi Kominami, Tokyo (JP)

(73) Assignee: MITSUBISHI HEAVY INDUSTRIES AUTOMOTIVE THERMAL SYSTEMS CO., LTD., Kiyosu-shi (JP)

( * ) Notice: Subject to any disclaimer, the term of this patent is extended or adjusted under 35 U.S.C. 154(b) by 324 days.

(21) Appl. No.: 14/002,296

(22) PCT Filed: Aug. 6, 2012

(86) PCT No.: PCT/JP2012/069965

§ 371 (c)(1),
(2), (4) Date: Aug. 29, 2013

(87) PCT Pub. No.: WO2013/018918

PCT Pub. Date: Feb. 7, 2013

(65) Prior Publication Data

US 2013/0334200 A1 Dec. 19, 2013

(30) Foreign Application Priority Data

Aug. 4, 2011 (JP) ..... 2011-171153

(51) Int. Cl.
*H05B 1/02* (2006.01)

(52) U.S. Cl.
CPC ..... *H05B 1/0288* (2013.01); *H05B 1/0236* (2013.01); *H05B 2203/02* (2013.01)

(58) Field of Classification Search
CPC .. H05B 1/0236; H05B 1/0238; H05B 1/0288; H05B 2203/03; H05B 2203/007; H05B 3/0042; H05B 3/12; H05B 3/14
USPC ..... 219/202, 504, 505, 483–486, 497
See application file for complete search history.

(56) References Cited

U.S. PATENT DOCUMENTS

2002/0125859 A1 9/2002 Takeo et al.
2007/0193998 A1 8/2007 Ichino
2010/0209131 A1 8/2010 Kagawa et al.

FOREIGN PATENT DOCUMENTS

JP 02-301983 A 12/1990
JP 03-159091 A 7/1991

(Continued)

OTHER PUBLICATIONS

International Search Report for PCT/JP2012/069965, Mailing Date of Aug. 28, 2012.
Written Opinion for PCT/JP2012/069965, Mailing Date of Aug. 28, 2012.

(Continued)

*Primary Examiner* — Mark Paschall
(74) *Attorney, Agent, or Firm* — Westerman, Hattori, Daniels & Adrian, LLP

(57) ABSTRACT

A heater control device includes a current calculating unit (20) which calculates a third value of current based on a first value of current flowing through a first PTC element of a first PTC heater which is in an energized state and a second value of current estimated to flow through a second PTC element of a second PTC heater which is to be newly put into an energized state next, and a switching control unit (21) which maintains a non-energized state of the second PTC element of the second PTC heater until it is determined that the third value of current calculated by the current calculating unit (20) is less than a predetermined maximum allowable value of current and puts the second PTC element of the second PTC heater into an energized state when the third value of current is less than the predetermined maximum allowable value of current.

7 Claims, 6 Drawing Sheets

(56) References Cited

FOREIGN PATENT DOCUMENTS

| | | | |
|---|---|---|---|
| JP | 08-152179 | A | 6/1996 |
| JP | 2005-24779 | A | 1/2005 |
| JP | 2005-090314 | A | 4/2005 |
| JP | 2005-257746 | A | 9/2005 |
| JP | 2006-010173 | A | 1/2006 |
| JP | 2006-162099 | A | 6/2006 |
| JP | 2007-283790 | A | 11/2007 |
| WO | 2005/011331 | A1 | 2/2005 |

OTHER PUBLICATIONS

Extended European Search Report dated Mar. 20, 2015, issued in corresponding European Patent Appliction No. 12820390.8 (8 pages).

Decision to Grant a Patent dated Aug. 19, 2015 in counterpart Chinese Patent Application No. 201280017011.X, with English translation (4 pages). Explanation of relevance—"The Decision to Grant a Patent has been received.".

Decision to Grant a Patent dated Dec. 22, 2015, issued in counterpart Japanese Patent Application No. 2011-171153. (3 pages). Concise English Language Explanation of Relevance: The Decision to Grant a Patent has been received.

HEATER CONTROL DEVICE, AND CONTROL METHOD AND CONTROL PROGRAM FOR HEATER CONTROL DEVICE

TECHNICAL FIELD

The present invention relates to a heater control device, and a control method and a control program for the heater control device, which are suitable for use in, for example, an in-vehicle PTC (Positive Temperature Coefficient) heater.

BACKGROUND ART

For example, PTC heaters which are one form of electric heaters have a structure in which heat is generated by energizing a PTC element which is a resistive element having a positive temperature coefficient by a DC power supply (for example, PTL 1). PTC heaters are widely used because a resistance thereof rapidly increases as temperature increases at a certain timing and thus a constant temperature can be maintained by simple energization from the DC power supply, leading to a simple control structure.

CITATION LIST

Patent Literature

{PTL 1}
the Publication of Japanese. Patent No. 2005-162099

SUMMARY OF INVENTION

Technical Problem

However, because in PTC heaters, an electric resistance value falls once as temperature of a PTC element increases (at a timing where a PTC element temperature is Tmin and a vertical axis is at Rmin) as shown in FIG. 7, which generates an inrush current that is a maximized current after the PTC element is energized as shown in FIG. 8, there is a problem that cost increases in order to provide a member to withstand a maximum value of the inrush current. Further, when PTC heaters have a plurality of PTC elements, if the plurality of PTC elements are put into an ON state at the same time to be quickly energized, inrush currents are superimposed, which results in exceeding of a current limit value. Accordingly, because it is necessary to sequentially put the PTC elements into an ON state one after another, there is a problem that the PTC elements cannot be energized quickly.

The present invention has been made in order to solve the above-described problems, and therefore has an object to provide a heater control device, and a control method and a control program for the heater control device which can keep cost down and which can energize a plurality of PTC elements quickly.

Solution to Problem

The present invention provides a heater control device to be applied to a heater unit which includes at least two PTC heaters having PTC elements, the heater control device including a current calculating unit which calculates a third value of current based on a first value of current flowing through a first PTC element of a first PTC heater which is presently in an energized state and a second value of current estimated to flow through a second PTC element of a second PTC heater which is to be newly put into an energized state next, and a switching control unit which maintains a non-energized state of the second PTC element of the second PTC heater until it is determined that the third value of current calculated by the current calculating unit is less than a predetermined maximum allowable value of current, and puts the second PTC element of the second PTC heater into the energized state when the third value of current is less than the predetermined maximum allowable value of current.

According to this configuration, it is determined whether or not the third value of current which is calculated based on the first value of current flowing through the first PTC element which is presently in an energized state, and the second value of current estimated to flow through the second PTC element which is to be newly put into an energized state next, is less than the maximum allowable value of current, and until the third value of current becomes less than the maximum allowable value of current, the second PTC element is maintained in a non-energized state and stands by for energization, and when the third value of current is less than the maximum allowable value of current, the second PTC element of the second PTC heater is put into the energized state.

In this way, because the second PTC element will not be energized until it is determined that the third value of current calculated based on the present value of current (first value of current) and a value of current (second value of current) which is estimated to flow when the second PTC element is newly energized is less than the maximum allowable value of current, there is no case where the heater unit is driven while the maximum allowable value of current is exceeded, so that it is possible to restrict inrush currents.

Further, by switching the second PTC element from the non-energized state to the energized state when the third value of current is less than the maximum allowable value of current, the time for the second PTC element to be put into the energized state becomes the shortest, so that it is possible to quickly complete energization of the whole heater unit. Further, because the energized state and the non-energized state are switched by comparing the value of current with the predetermined maximum allowable value of current, it is not necessary to take action, for example, excessively increasing members to avoid exceeding of the maximum current or using expensive members which can withstand the maximum current, so that it is possible to reduce, for example, a substrate pattern width, a diameter of a cable (HV wire) and capacitance of protection fuse rating, which leads to downsizing of the whole equipment and cost reduction.

It is also possible to provide a selecting unit which selects the PTC heater to be put into the energized state from a plurality of PTC heaters in the above-described heater control device in a descending order of power consumption of the PTC heaters.

Because a PTC heater with larger power consumption generates a greater inrush current, by putting the PTC heaters into the energized state in a descending order of power consumption, it is possible to prevent, for example, a situation where a value of current considerably exceeds the maximum allowable value of current finally while the PTC heaters are sequentially put into the energized state.

It is preferable that the switching control unit of the above-described heater control device includes switching elements that respectively correspond to the PTC elements and switches the PTC elements between energization and non-energization by switching the switching elements between an ON state and an OFF state.

This configuration makes it possible to easily switch the PTC elements between energization and non-energization.

The above-described heater control device may include additional resistances which are provided in series to the PTC elements.

By providing the additional resistances in series to the PTC elements in this manner, it is possible to raise a level of a minimum value of a PTC element resistance value, generated when a PTC element temperature is increased, so that it is possible to reduce inrush currents. Further, when normal resistances are connected in series to the PTC elements, because the connected resistances at Curie temperature are negligible small, it is possible to reduce inrush currents while raising only the level of the minimum value of the resistance without lowering the output.

In the above-described heater control device, the resistance value of the additional resistances are preferably set so as to be greater than a second calculation value obtained by subtracting the minimum value of the resistance of the PTC elements from a first calculation value which is obtained by dividing a maximum voltage by the maximum allowable value of current.

By calculating the resistance value of the additional resistances based on the maximum allowable value of current, a current flowing through the heater unit never exceeds the maximum allowable value of current.

The present invention provides a control method for a heater control device to be applied to a heater unit which includes at least two PTC heaters having PTC elements, the control method including a current calculating stage of calculating a third value of current based on a first value of current flowing through a first PTC element of a first PTC heater which is presently in an energized state and a second value of current estimated to flow through a second PTC element of a second PTC heater which is to be newly put into an energized state next, and a switching control stage of maintaining a non-energized state of the second PTC element of the second PTC heater until it is determined that the calculated third value of current is less than a predetermined maximum allowable value of current and putting the second PTC element of the second PTC heater into an energized state when the third value of current is less than the predetermined maximum allowable value of current.

The present invention provides a control program for a heater control device to be applied to a heater unit which includes at least two PTC heaters having PTC elements, the control program causing a program to execute current calculating processing for calculating a third value of current based on a first value of current flowing through a first PTC element of a first PTC heater which is presently in en energized state and a second value of current estimated to flow through a second PTC element of a second PTC heater which is to be newly put into an energized state next, and switching control processing for maintaining a non-energized state of the second PTC element of the second PTC heater until it is determined that the calculated third value of current is less than a predetermined maximum allowable value of current and putting the second PTC element of the second PTC heater into an energized state when the third value of current is less than the predetermined maximum allowable value of current.

Advantageous Effects of Invention

The present invention provides an advantage of making it possible to keep cost down and energize a plurality of PTC elements quickly.

DESCRIPTION OF EMBODIMENTS

Embodiments of a heater control device, and a control method and a control program for the heater control device according to the present invention will be described below with reference to the drawings.

First Embodiment

This embodiment assumes a case where a heater unit including three PTC heaters having PTC elements is used as an PTC heater, and will be described assuming that a heater control device of this embodiment is applied to the in-vehicle PTC heater.

Figure 1:
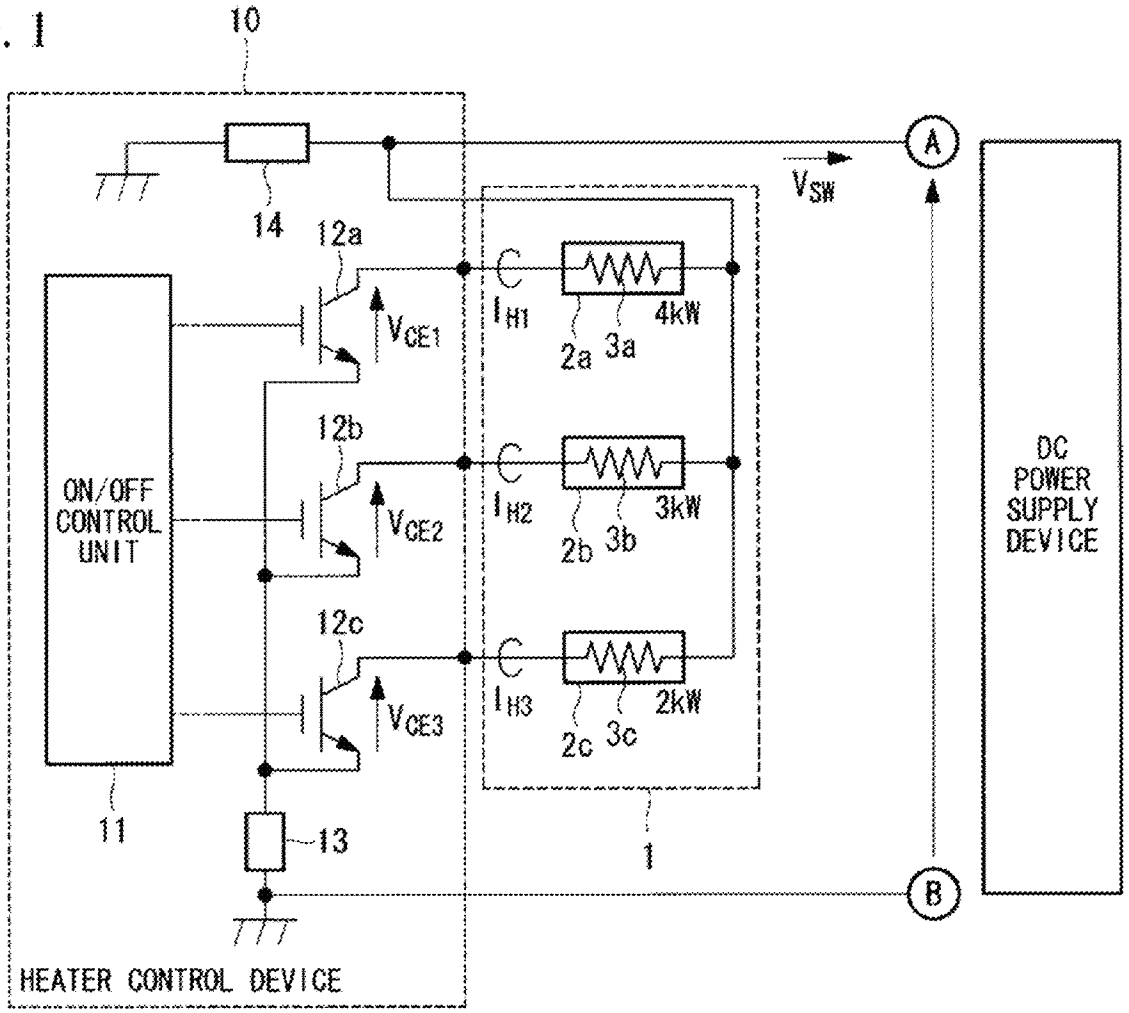
FIG. 1 is a schematic configuration diagram of a heater control device according to a first embodiment of the present invention.

FIG. 1 is a schematic configuration diagram of the heater control device 10 applied to the in-vehicle PTC heater.

In this embodiment, the heater unit 1 includes the PTC heaters 2*a*, 2*b* and 2*c*, which respectively have the PTC elements 3*a*, 3*b* and 3*c*. Hereinafter, unless specifically noted, the PTC heaters will be described as PTC heaters 2, and the PTC elements will be described as PTC elements 3. In addition, while this embodiment will be described assuming a case where the heater unit 1 has three PTC heaters, the number of PTC heaters may be at least two and is not particularly limited.

Further, while this embodiment assumes a case where power consumption of the PTC heaters 2*a*, 2*b* and 2*c* is respectively 4 kW, 3 kW and 2 kW, the power consumption of the PTC heaters 2 is not limited thereto.

Still further, a PTC heater 2 which is presently in an energized state is referred to as a first PTC heater, and a PTC heater 2 which is to be newly put into an energized state next is referred to as a second PTC heater. Because, in this embodiment, the PTC heaters 2 are sequentially energized in a descending order of power consumption, this embodiment will be described assuming that the first PTC heater which has been already energized is the PTC heater 2*a*, and the second PTC heater is the PTC heater 2*b*.

As shown in FIG. 1, an upstream side of the PTC heaters 2*a*, 2*b* and 2*c* is connected to a terminal A which is a positive side of a DC power supply device through the heater control device 10, and a downstream side is connected to a terminal B which is a negative side of the DE power supply device through the heater control device 10.

The heater control device 10 includes an ON/OFF control unit 11, switching elements 12*a*, 12*b* and 12*c*, a current detecting unit 13 and a voltage detecting unit 14. Hereinafter, unless specifically noted, the switching elements will be described as switching elements 12.

The switching elements 12*a*, 12*b* and 12*c* are provided so as to respectively correspond to the PTC heaters 2*a*, 2*b* and 2*c*. Further, the switching elements 12*a*, 12*b* and 12*c*, which are connected to the ON/OFF control unit 11, are controlled to be turned ON and OFF based on a control signal output from the ON/OFF control unit 11 so as to switch the PTC heaters 2*a*, 2*b* and 2*c* between energization and non-energization.

The current detecting unit 13 measures a value of current on a path on which the current detecting unit 13 is provided, and outputs information of the measured value of current to the ON/OFF control unit 11.

The voltage detecting unit 14, which is provided on the positive side of the DC power supply device, measures a voltage value of the heater unit 1 and outputs information of the measured voltage value to the ON/OFF control unit 11.

Figure 2:
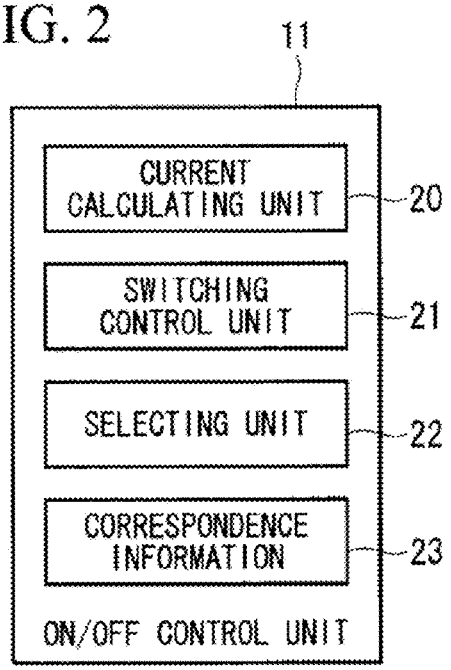
FIG. 2 is a functional block diagram showing functions of an ON/OFF control unit in an expanded manner according to the first embodiment of the present invention.

FIG. 2 is a functional block diagram showing functions of the ON/OFF control unit 11 in an expanded manner. As shown in FIG. 2, the ON/OFF control unit 11 includes a current calculating unit 20, a switching control unit 21, a selecting unit 22 and correspondence information 23.

In the correspondence information 23, information of a minimum resistance value Rmin of each of the PTC element 3 is associated with information of power consumption for each of the PTC heaters 2.

The current calculating unit 20 calculates an inrush current estimation value (third value of current) based on a first value of current flowing through the PTC element 3*a* (first PTC element) of the PTC heater 2*a* (first PTC heater) which is presently in an energized state, and a second value of current estimated to flow through the PTC element 3*b* (second PTC element) of the PTC heater 2*b* (second TC heater) which is to be newly put into an energized state next.

Specifically, the current calculating unit 20 sets the value of current acquired from the current detecting unit 13 as the first value of current Inow flowing through the PTC element 3*a* (first PTC element) of the PTC heater 2 (first PTC heater) which is presently in an energized state. Further, the current calculating unit 20 divides a high voltage detection value Vhv detected by the voltage detecting unit 14 by the minimum resistance value Pmin of the second PTC heater which is to be newly put into an energized state next to calculate the result as the second value of current Inxt. Here, the minimum resistance value Pmin is defined based on the specification of PTC manufacturers and may include an error.

Further, the current calculating unit 20 calculates a sum of the first value of current Inow and the second value of current Inxt and sets the sum as the inrush current estimation value (third value of current) Irush which is a maximum value of current of the heater unit 1 (see the following equation (1)).

$$\text{First value of current Inow} + \text{second value of current Inxt} = \text{inrush current estimation value Irush} \quad (1)$$

The switching control unit 21 maintains the non-energized state of the PTC element 3*b* (second PTC element) of the PTC heater 1*b* (second PTC heater) until it is determined that the inrush current estimation value (third value of current) Irush calculated by the current calculating unit 20 is less than a predetermined maximum allowable value of current, and, when the inrush current estimation value Irush becomes less than the predetermined maximum allowable value of current, puts the PTC element 3*b* (second PTC element) of the PTC heater 2*b* (second PTC heater) into an energized state. Here, the maximum allowable value of current Imax is defined in advance based on requirements specification, or the like, and is, for example, 2.5 ampere (A).

The selecting unit 22 selects a PTC heater 2 to be put into an energized state from a plurality of PTC heaters 2 in a descending order of power consumption of the PTC heaters 2. Specifically, the selecting unit 22 reads the above-described correspondence information 23 and selects the PTC heaters 2 to be put into an energized state in a descending order of power consumption of the PTC heaters 2. This embodiment is described assuming that the PTC heater 2*a* is put into an energized state first, the PTC heater 2*b* is put into an energized state secondly, and the PTC heater 2*c* is put into an energized state thirdly.

A control method in the above-described heater control device 10 will be described next using FIG. 1 to FIG. 4.

When power requirement of the in-vehicle PTC heater changes from power requirement I (for example, 4 kW) to power requirement II (for example, 7 kW) at time T1, if the switching element 12*a* is turned ON, the PTC element 3*a* is put into an ON state, and the PTC heater 2*a* is energized. When the PTC heater 2*a* is energized and an inrush current flows, the value of current I1 flowing through the heater unit 1 reaches its peak and is gradually settled. At this time, the selecting unit 22 of the ON/OFF control unit 11 selects the PTC heater 2*b* as the PTC heater 2 which has the second largest power consumption after the PTC heater 2*a* which is presently used, with reference to the correspondence information 23.

When the current calculating unit 20 acquires a current measurement value from the current detecting unit 13, the current calculating unit 20 sets the measurement value as the first value of current Inow. Further, the current calculating unit 20 divides the high voltage detection value Vhv measured by the voltage detecting unit 14 by the minimum resistance value Rmin of the PTC heater 2*b* selected as the PTC heater 2 having the second largest power consumption, thereby calculating the second value of current. Inxt (=Vhv/Rmin) which is estimated to flow through the PTC beater 2*b*.

Further, the current calculating unit 20 calculates a sum of the first value of current Inow and the second value of current Inxt as the inrush current estimation value Irush (=Inow+Inxt) and determines whether or not the inrush current estimation value. Irush is smaller than the maximum allowable value of current Imax. As a result of the determination, until the inrush current estimation value Irush<the maximum allowable value of current Imax the second PTC element 3*b* stands by for energization. When the inrush current estimation value Irush<the maximum allowable value of current Imax at time T2, the switching control unit 21 switches the switching element 12*b* from an OFF state to an ON state and puts the PTC element 3*b* into an ON state so as to energize the PTC heater 2*b*.

Figure 3:
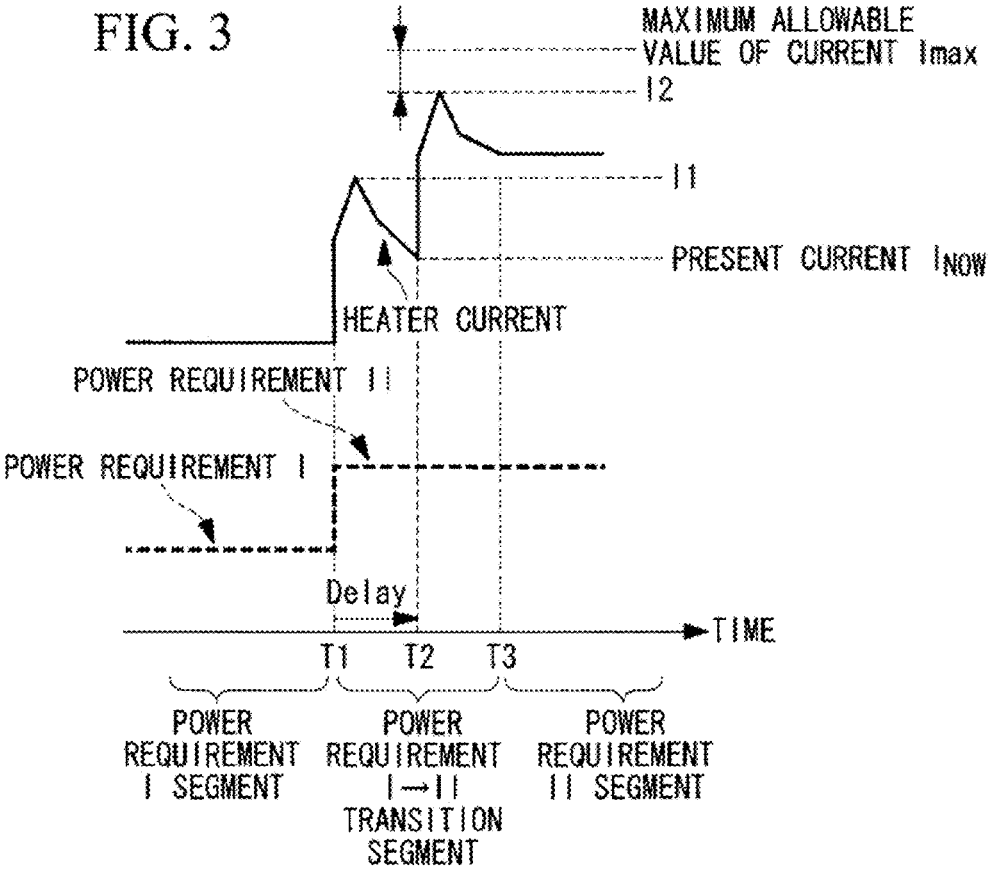
FIG. 3 is an example illustrating tendency of a current in a case where PTC heaters are sequentially energized.

By this means, as shown in FIG. 3, even when an inrush current is generated by energization of the PTC heater 2*b*, the value of current of the current flowing through the heater unit 1 reaches its peak value of current I2 and is gradually settled without exceeding the maximum allowable value of current Imax. At time T3, the value of current flowing through the heater unit 1 becomes stable, and a stable output power which satisfies power requirement II is supplied.

Figure 4:
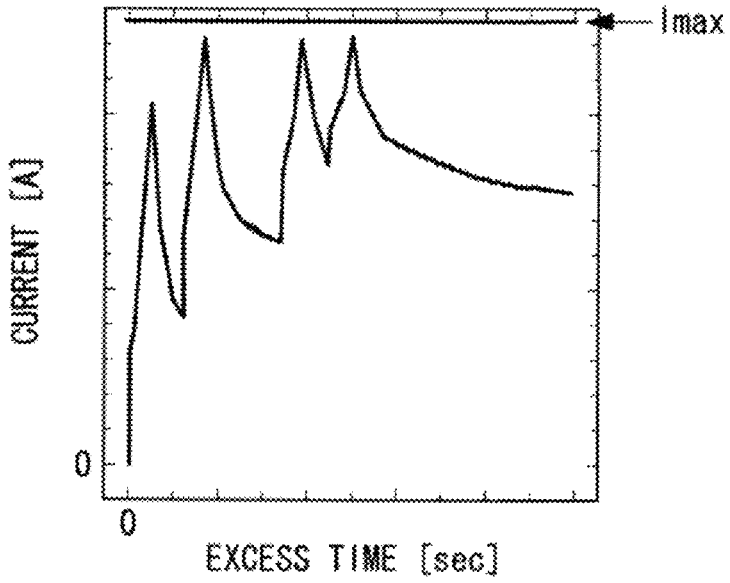
FIG. 4 is another example illustrating tendency of a current in a case where the PTC heaters are sequentially energized.

It is determined whether or not the output power satisfies the power requirement, and when the output power satisfies the power requirement, this processing is finished. When the output power does not satisfy the power requirement, the above-described processing is repeated, and control is performed so that the output power of the heater unit 1 satisfies the power requirement while monitoring is performed so that the value of current flowing through the heater unit 1 does not exceed the maximum allowable value of current Imax. By repeating this processing, it is possible to realize operation while maintaining the value of current less than a specified maximum allowable value of current Imax and to provide desired output power in a shortest period of time as shown in FIG. 4.

The above-described heater control device according to the embodiment may be configured to process all or part of the above processing using software provided separately. In this case, the heater control device includes a CPU, a main memory such as RAM, and a computer readable recording medium in which a program for implementing all or part of the above processing is recorded. The CPU reads the program recorded in the above recording medium, executes processing and arithmetic processing on information, thereby realizing the similar processing to that performed by the above-described heater control device. Here, the computer readable recording medium includes a magnetic disc, a magnetic optical disc, a CD-ROM, a DVD-ROM, a semiconductor memory, or the like. It is further possible to distribute this computer program to a computer using line and make the computer to which the computer program is distributed execute the program.

As described above, according to the heater control device, the method and the program according to this embodiment, it is determined whether or not the third value of current (inrush current estimation value) calculated based on the first value of current flowing through the first PTC element (PTC element 3*a*) which is presently in an energized state and the second value of current estimated to flow through the second PTC element (PTC element 3*b*) when being newly energized next is less than the maximum allowable value of current, and until the third value of current becomes less than the maximum allowable value of current, the second PTC element (PTC element 3*b*) is maintained in a non-energized state and stands by for energization, and, when the third value of current is less than the maximum allowable value of current, the second PTC element (PTC element 3*b*) of the second PTC heater (PTC heater 2*b*) is put into an energized state.

In this way, because the second PTC element will not be energized until it is determined that the third value of current calculated based on the present value of current (first value of current) and the value of current (second value of current) estimated to flow through the second PTC element when being newly energized is less than the maximum allowable value of current, there is no case where the heater unit 1 is driven while the maximum allowable value of current Imax is exceeded, so that it is possible to restrict inrush currents.

Further, when the third value of current is less than the maximum allowable value of current, the second PTC element (PTC element 3*b*) is switched from a non-energized state to an energized state, which makes a time to put the second PTC element (PTC element 3*b*) into the energized state the shortest, so that it is possible to complete energization of the whole heater unit quickly. Further, because the energized state and the non-energized state are switched by comparing the value of current with the predetermined maximum allowable value of current Imax, it is not necessary to take action, for example, excessively increasing members to avoid exceeding of the maximum current or using expensive members which can withstand the maximum current, so that it is possible to reduce, for example, a substrate pattern width, a diameter of a cable (HV wire) and capacitance of protection fuse rating, which leads to downsizing of the whole equipment and cost reduction.

Second Embodiment

Next, a second embodiment of the present invention will be described using FIG. 5.

A difference between a heater control device according to this embodiment and the heater control device according to the first embodiment is that a load resistance is provided for each PTC heater in the heater control device according to this embodiment. The heater control device according to this embodiment will be described below while points in common with the first embodiment will not be described and differences will be mainly described.

Figure 5:
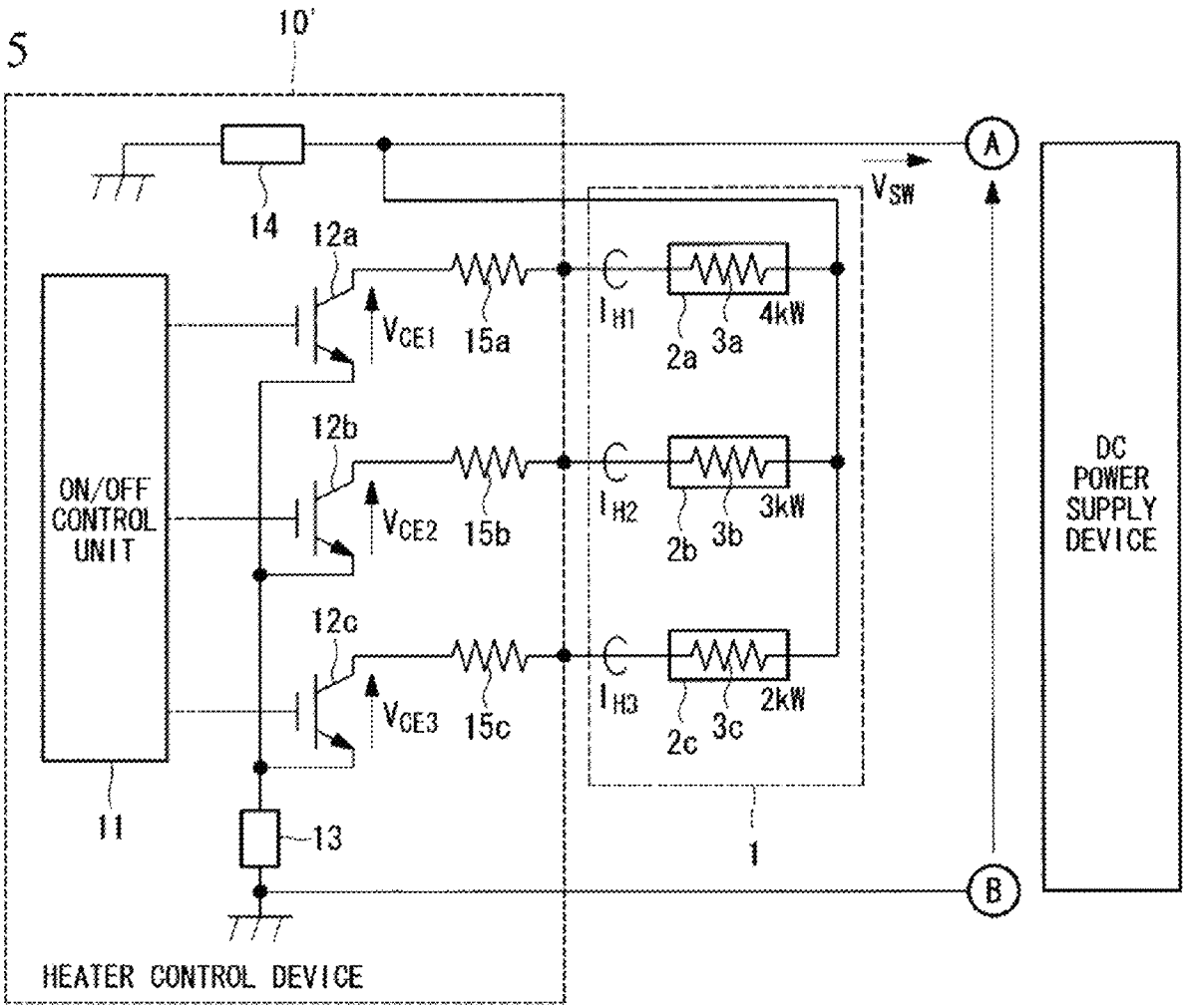
FIG. 5 is a schematic configuration diagram of a heater control device according to a second embodiment of the present invention.

FIG. 5 is a schematic configuration diagram of a heater control device 10 applied to an in-vehicle PTC heater.

As shown in FIG. 5, in the heater control device 10', additional resistances 15*a*, 15*b* and 15*c* are respectively provided in series to the PTC heaters 2*a*, 2*b* and 2*c*. Hereinafter, unless specifically noted, the additional resistances will be described as additional resistances 15.

The additional resistances 15 are, for example, formed with a normal nichrome wire, or the like, and are set so as to be greater than a value obtained by subtracting a minimum resistance value of PTC elements from a value which is obtained by dividing a maximum voltage value by a maximum allowable value of current Imax, as expressed by the following equation (2):

$$\text{Additional resistances} > \text{maximum voltage value/maximum allowable value of current Imax} - \text{minimum resistance value Rmin} \quad (2)$$

Further, the level of the additional resistances 15 is preferably set to be greater than a value obtained by subtracting the minimum resistance value Rmin of the PTC elements from a resistance value (=rated voltage/maximum allowable value of current) for making a value of current equal to or less than the maximum allowable value of current Imax and to be sufficiently smaller than a resistance value Rc at Curie temperature as expressed by the following equation (3), so as to minimize a change of temperature characteristics of a single PTC element:

$$\text{Rated voltage/maximum allowable value of current Imax} - \text{minimum resistance value Pmin} < \text{additional resistance value} \ll \text{resistance value Pc of the PTC elements at Curie temperature} \quad (3)$$

Figure 6:
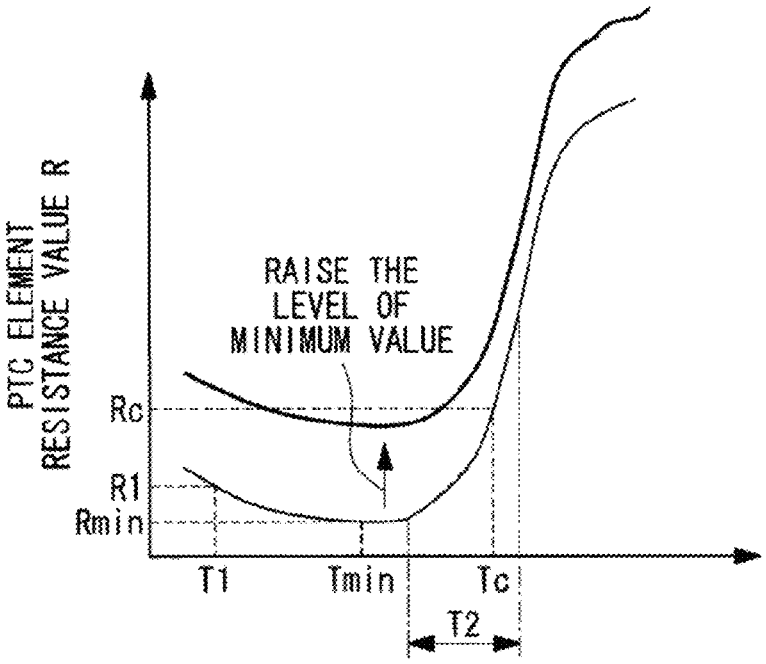
FIG. 6 illustrates a state where a level of a minimum resistance value is raised by additional resistances.
Figure 7:
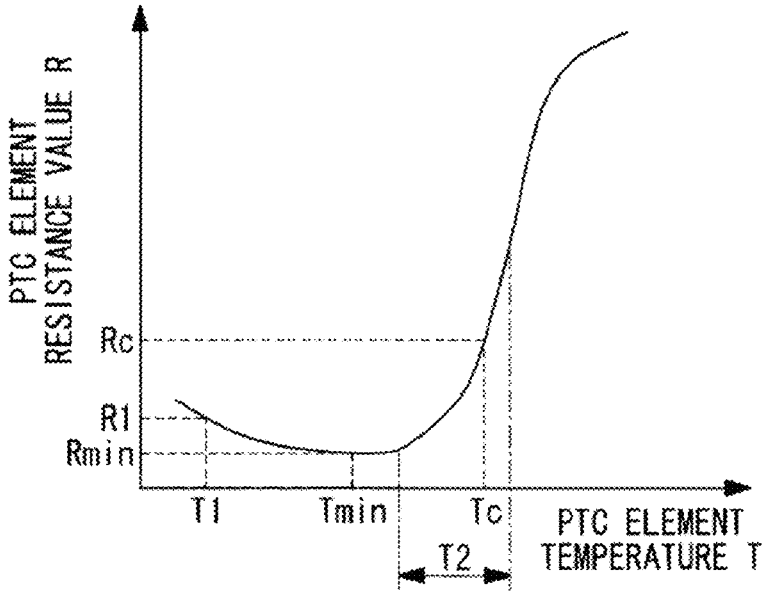
FIG. 7 shows temperature characteristics of a PTC element of a conventional PTC heater.
Figure 8:
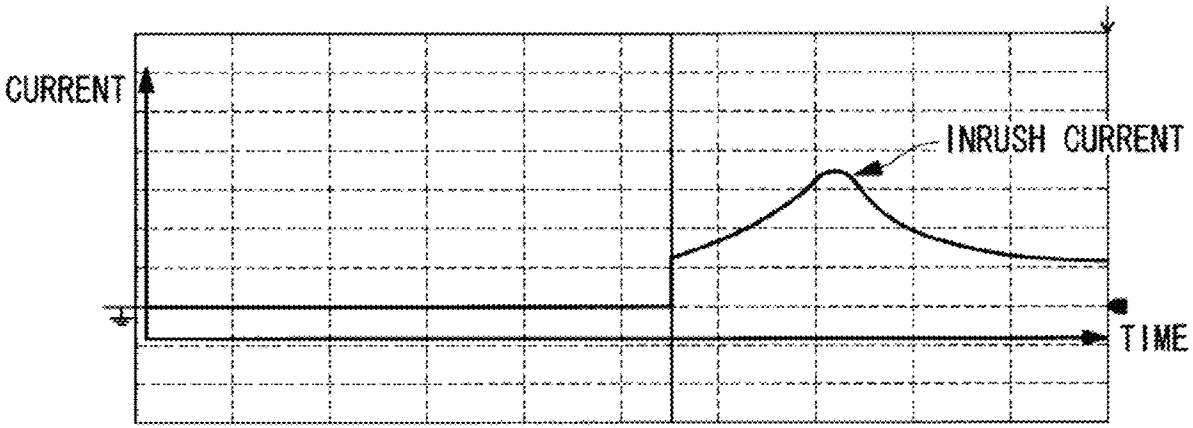
FIG. 8 shows a current waveform when the PTC element of the conventional PTC heater is energized.

In this way, by providing additional resistances 15 in series to the PTC elements and raising a level of the minimum resistance value Rmin of the PTC elements (minimum value of the PTC elements) generated when a temperature of the PTC elements is increased (see FIG. 6), combined resistance becomes large, which makes it possible to reduce inrush currents. Further, because the connected resistances at Curie temperature are negligible small when normal resistances are connected in series to the PTC elements, it is possible to reduce inrush currents while raising only the level of the minimum value of the resistance without lowering the output.

While in this embodiment, a case has been described where the additional resistances 15*a*, 15*b* and 15*c* are respectively provided in series to the PTC heaters 2*a*, 2*b* and 2*c* as shown in FIG. 5, arrangement of the additional resistances 15 is not limited thereto. For example, it is also possible to provide the additional resistance 15*a* in series only to the PTC heater 2*a* which has the largest power consumption.

REFERENCE SIGNS LIST

2, 2*a*, 2*b*, 2*c* PTC heater
3, 3*a*, 3*b*, 3*c* PTC element
10, 10' heater control device
11 ON/OFF control unit
12, 12*a*, 12*b*, 12*c* switching element
13 current detecting unit
15, 15*a*, 15*b*, 15*c* additional resistance
20 current calculating unit
21 switching control unit
22 selecting unit
23 correspondence information
Inow first value of current
Imax maximum allowable value of current

The invention claimed is:

1. A heater control device to be applied to a heater unit provided with a plurality of PTC heaters each of which comprises a PTC element which is a resistive element in which a current flowing therethrough reaches its peak value as its resistance value falls once when energized and then its resistance increases, the heater control device comprising:

a switching control unit which sequentially energizes the PTC element which is included in each of the plurality of PTC heaters, one after another;

a current detecting unit provided on a current path to the heater unit and which detects a first value of current flowing through a first PTC element of a first PTC heater among the plurality of PTC heaters, the first PTC heater being presently in an energized state; and a current calculating unit which acquires the first value of current which is detected by the current detecting unit, wherein the current calculating unit calculates a third value of current that is the sum of the first value of current which is acquired and a second value of current estimated as a maximum value to flow through a second PTC element of a second PTC heater which is to be put into an energized state next to the first PCT heater; and the switching control unit which maintains a non-energized state of the second PTC element of the second PTC heater until it is determined that the third value of current calculated by the current calculating unit is less than a predetermined maximum allowable value of current which is stored in advance, and puts the second PTC element of the second PTC heater into an energized state when the third value of current is less than the predetermined maximum allowable value of current.

2. The heater control device according to claim 1, further comprising:

a selecting unit which selects the PTC heater to be put into an energized state from the PTC heaters in a descending order of power consumption of the PTC heaters.

3. The heater control device according to claim 1, wherein the switching control unit comprises switching elements which respectively correspond to the PTC elements, and switches the PTC elements between energization and non-energization by switching the switching elements between an ON state and an OFF state.

4. The heater control device according claim 1, wherein additional resistances are provided in series to the PTC elements.

5. The heater control device according to claim 4, wherein a resistance value of the additional resistances is set so as to be greater than a second calculation value obtained by subtracting a minimum value of a resistance of the PTC elements from a first calculation value which is obtained by dividing a maximum voltage by the maximum allowable value of current.

6. A control method for a heater control device to be applied to a heater unit provided with a plurality of PTC heaters each of which comprises a PTC element which is a resistive element in which a current flowing therethrough reaches its peak value as its resistance value falls once when energized and then its resistance increases, the heater unit sequentially energizing the PTC elements each of which is included in each of the plurality of PTC heaters one after another, the control method comprising:

detecting a first value of current flowing through a first PTC element of a first PTC heater among the plurality of PTC heaters, the first PTC heater being presently in an energized state;

calculating a third value of current that is the sum of the first value of current which is detected and a second value of current estimated as a maximum value to flow through a second PTC element of a second PTC heater which is to be put into an energized state next to the first PCT heater; and maintaining a non-energized state of the second PTC element of the second PTC heater until it is determined that the calculated third value of current is less than a predetermined maximum allowable value of current which is stored in advance and putting the second PTC element of the second PTC heater into an energized state when the third value of current is less than the predetermined maximum allowable value of current.

7. A non-transitory computer readable medium in which a control program for a heater control device to be applied to a heater unit provided with a plurality of PTC heaters each of which comprises a PTC element which is a resistive element in which a current flowing therethrough reaches its peak value as its resistance value falls once when energized and then its resistance increases is stored, the heater unit sequentially energizing the PTC elements each of which is included in each of the plurality of PTC heaters one after another, the control program causing a program to execute:

detecting a first value of current flowing through a first PTC element of a first PTC heater among the plurality of PTC heaters, the first PTC heater being presently in an energized state;

calculating a third value of current that is the sum of the first value of current which is detected and a second value of current estimated as a maximum value to flow through a second PTC element of a second PTC heater which is to be put into an energized state next to the first PCT heater; and maintaining a non-energized state of the second PTC element of the second PTC heater until it is determined that the calculated third value of current is less than a predetermined maximum allowable value of current which is stored in advance and putting the second PTC element of the second PTC heater into an energized state when the third value of current is less than the predetermined maximum allowable value of current.

* * * * *